US009132628B2

(12) United States Patent
Shirato

(10) Patent No.: US 9,132,628 B2
(45) Date of Patent: Sep. 15, 2015

(54) RECORDING HEAD CONTROLLING APPARATUS, RECORDING HEAD, RECORDING APPARATUS, AND IMAGE FORMING APPARATUS

(71) Applicant: Takeo Shirato, Ibaraki (JP)

(72) Inventor: Takeo Shirato, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/473,070

(22) Filed: Aug. 29, 2014

(65) Prior Publication Data

US 2015/0062215 A1 Mar. 5, 2015

(30) Foreign Application Priority Data

Sep. 4, 2013 (JP) ..... 2013-183432

(51) Int. Cl.
*B41J 2/05* (2006.01)
*B41J 2/045* (2006.01)
*B41J 2/01* (2006.01)

(52) U.S. Cl.
CPC ..... *B41J 2/04573* (2013.01); *B41J 2/01* (2013.01); *B41J 2/04581* (2013.01)

(58) Field of Classification Search
None
See application file for complete search history.

(56) References Cited

U.S. PATENT DOCUMENTS 5,291,469 A * 3/1994 Yoshinaka ..... 369/69
7,568,776 B2 8/2009 Ito et al.

FOREIGN PATENT DOCUMENTS

| | | |
|---|---|---|
| JP | 09-262978 | 10/1997 |
| JP | 2006-218682 | 8/2006 |
| JP | 2008-100483 | 5/2008 |
| JP | 2010-131761 | 6/2010 |
| JP | 4655682 | 1/2011 |
| JP | 2011-046160 | 3/2011 |
| JP | 2012-171197 | 9/2012 |
| JP | 2013-078874 | 5/2013 |
| JP | 2013078874 A * | 5/2013 |

* cited by examiner

*Primary Examiner* — Erica Lin
(74) *Attorney, Agent, or Firm* — Harness, Dickey & Pierce, P.L.C.

(57) ABSTRACT

A recording head controlling apparatus includes: a restoration unit configured to restore a clock signal and an image signal from a serial signal in which the clock signal and the image signal are superimposed and store it in a storage unit; and a transmission control unit configured to receive a synchronization signal of a driving waveform to drive each piezoelectric element and transmit the image signal stored in the storage unit to a driving unit for driving the piezoelectric element at a timing corresponding to the synchronization signal.

5 Claims, 8 Drawing Sheets

RECORDING HEAD CONTROLLING APPARATUS, RECORDING HEAD, RECORDING APPARATUS, AND IMAGE FORMING APPARATUS

CROSS-REFERENCE TO RELATED APPLICATIONS

The present application claims priority to and incorporates by reference the entire contents of Japanese Patent Application No. 2013-183432 filed in Japan on Sep. 4, 2013.

BACKGROUND OF THE INVENTION

1. Field of the Invention

The present invention relates to a recording head controlling apparatus, a recording head, a recording apparatus, and an image forming apparatus.

2. Description of the Related Art

There has been known an image forming apparatus including a plurality of recording heads for discharging ink droplets from a plurality of nozzles. A plurality of wirings has been provided in the recording head in order to transmit various signals to respective piezoelectric elements provided corresponding to the nozzles. For this reason, there has been a case where complication of the wirings becomes a problem. Therefore, a method has been known in which a clock signal is superimposed on an image signal and the superimposed signal is serially transferred to the recording head (for example, refer to Japanese Laid-open Patent Publication No. 2013-78874). The wiring is simplified by superimposing the clock signal on the image signal and serially transferring the superimposed signal to the recording head in Japanese Laid-open Patent Publication No. 2013-78874.

However, at the time of generating a serial signal in which the image signal and the clock signal are superimposed and restoring the image signal and the clock signal from the serial signal, a gap of timing of several clock cycles may occur. Therefore, there has been a case where it has been difficult to synchronize the restored image signal and a driving waveform which is separately supplied and image quality is deteriorated.

Therefore, it is desirable to provide a recording head controlling apparatus, a recording head, a recording apparatus, and an image forming apparatus which can improve image quality.

SUMMARY OF THE INVENTION

It is an object of the present invention to at least partially solve the problems in the conventional technology.

According to an aspect of the present invention, there is provided a recording head controlling apparatus including: a restoration unit configured to restore a clock signal and an image signal from a serial signal in which the clock signal and the image signal are superimposed and store it in a storage unit; and a transmission control unit configured to receive a synchronization signal of a driving waveform to drive each piezoelectric element and transmit the image signal stored in the storage unit to a driving unit for driving the piezoelectric element at a timing corresponding to the synchronization signal. The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
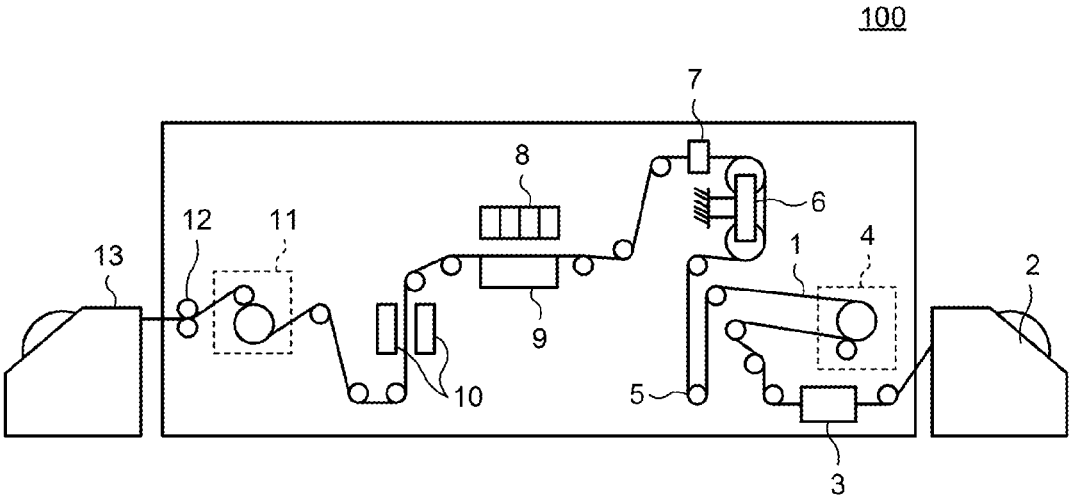
FIG. 1 is a schematic diagram of an ink jet recording apparatus.

An embodiment of a recording head controlling apparatus, a recording head, and an image forming apparatus will be described below in detail with referring to the drawings.

FIG. 1 is a schematic diagram of an ink jet recording apparatus 100. The ink jet recording apparatus 100 is provided in the downstream of a paper sheet feeding unit 2 for supplying a record medium 1 in a transporting direction of the record medium 1. Also, the ink jet recording apparatus 100 is arranged in the upstream of a paper sheet collecting unit 13 for collecting the record medium 1 in the transporting direction of the record medium 1. The ink jet recording apparatus 100 may include the paper sheet feeding unit 2 and the paper sheet collecting unit 13.

The record medium 1 may be a paper sheet divided into a predetermined size or may be continuous paper sheets for continuing in the transporting direction. In the present embodiment, a case where the record medium 1 is the continuous paper sheets will be described as an example. However, it is not limited to this configuration.

The record medium 1 is supplied from the paper sheet feeding unit 2 to the ink jet recording apparatus 100 by a transport mechanism and the like which is not shown. An image is formed on the record medium 1, which has been supplied to the ink jet recording apparatus 100, by a recording apparatus 8 (to be described in detail below). The record medium 1 having the image has been formed thereon is sequentially rewinded and collected by the paper sheet collecting unit 13.

The ink jet recording apparatus 100 includes a paper sheet transport mechanism which transports the record medium 1. The paper sheet transport mechanism includes a regulatory guide 3, an in-feed unit 4, a dancer roller 5, an edge position control (EPC) 6, a meandering amount detector 7, an out-feed unit 11, and a puller 12. The regulatory guide 3 positions the record medium 1, which has been supplied from the paper sheet feeding unit 2, in a width direction.

The in-feed unit 4 includes a driving roller and a driven roller. The record medium 1 is sandwiched between and transported by these rollers. In order to constantly maintain tension at the time of the transportation of the record medium 1, the dancer roller 5 moves up and down corresponding to the tension of the record medium 1. The EPC 6 controls meandering of the record medium 1. The meandering amount detector 7 detects a meandering direction and a meandering amount of the record medium 1 and outputs the detection result to the EPC 6. The EPC 6 controls a mechanism which is not shown to suppress the meandering of the record medium 1 by using the detection result from the meandering amount detector 7.

The out-feed unit 11 includes the driving roller and the driven roller. The record medium 1 is sandwiched between the driving roller and the driven roller of the out-feed unit 11, and the out-feed unit 11 transports the record medium 1 at a constant speed. The puller 12 ejects the record medium 1 toward the paper sheet collecting unit 13. The puller 12 includes the driving roller and the driven roller. The record medium 1 is sandwiched between and transported by these rollers so that the puller 12 ejects the record medium 1.

Also, the ink jet recording apparatus 100 includes the recording apparatus 8, a platen 9, and a drying unit 10. The recording apparatus 8 forms the image by discharging the ink droplets on the record medium 1. The platen 9 is arranged opposite to an ink discharging surface of the recording apparatus 8 at a predetermined interval and holds the record medium 1. The recording apparatus 8 discharges the ink droplets toward the platen 9 according to a transport speed of the record medium 1. Accordingly, the image by the ink droplets is formed in an area of the platen 9 on the record medium 1. The drying unit 10 dries the ink droplets discharged on the record medium 1 so as to fix them on the record medium 1.

Figure 2:
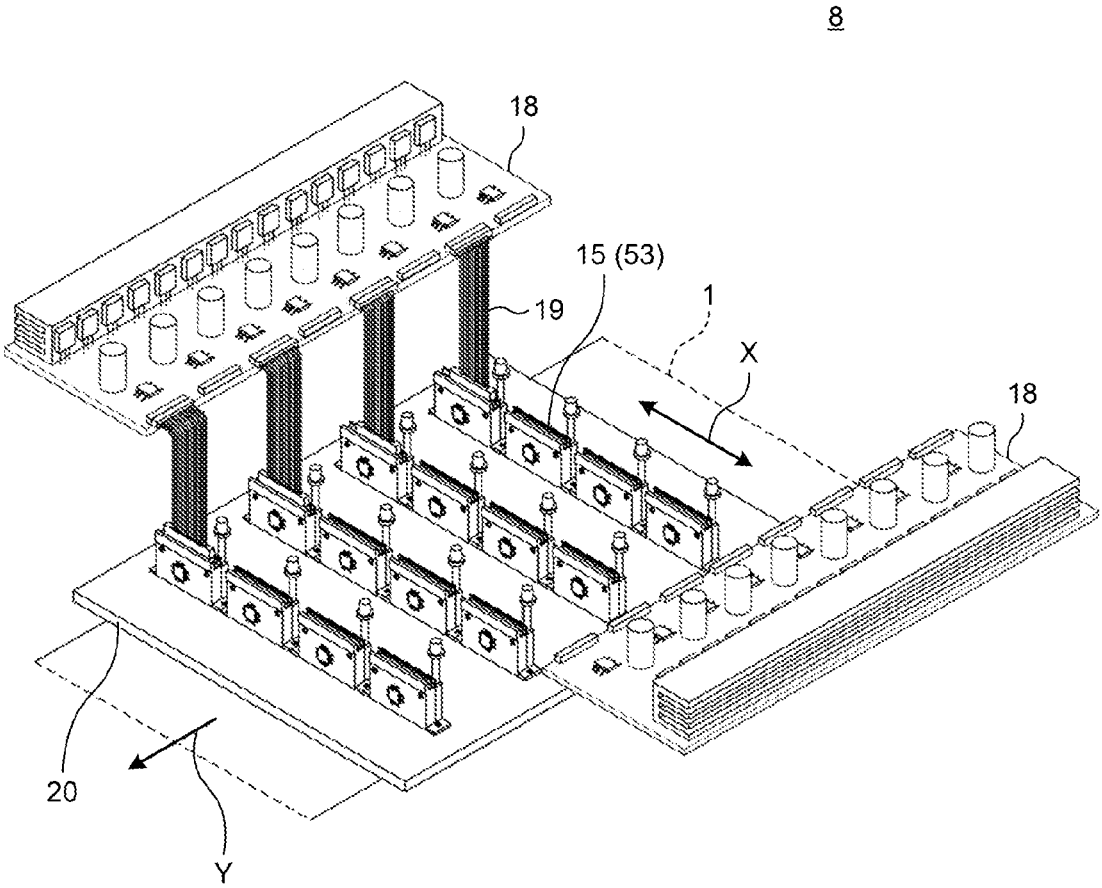
FIG. 2 is a schematic diagram of a recording apparatus.

FIG. 2 is a schematic diagram of the recording apparatus 8. The recording apparatus 8 includes a drive control board 18 and a plurality of recording heads 15. The drive control board 18 is electrically connected to each recording head 15 by a cable 19. Piezoelectric elements 53 are provided respectively corresponding to a plurality of nozzles, which discharge the ink droplets, in the respective recording heads 15.

The drive control board 18 is a rigid board having a driving waveform to drive each piezoelectric element 53 provided in each recording head 15 and a circuit which generates an image signal and the like to control ON/OFF of each piezoelectric element 53 mounted thereon. The drive control board 18 generates the driving waveform and the image signal by a known method based on an image data of the image to be formed.

The plurality of recording heads 15 is arranged in the transporting direction of the record medium 1 (refer to a direction of an arrow Y in FIG. 2) at predetermined intervals and in a direction perpendicular to the transporting direction (refer to a direction of an arrow X in FIG. 2). The plurality of recording heads 15 is placed on a plate 20 to be arranged in the above arrangement.

The recording head 15 discharges the ink droplets on the record medium 1 according the driving waveform and the image signal to be transmitted from the drive control board 18. Specifically, the image signal controls ON/OFF of the respective piezoelectric elements 53 provided in the plurality of recording heads 15 according to the image to be formed and the transport speed of the record medium 1. The driving waveform is a waveform of a pulse width and a voltage level according to an ink droplet amount discharged from the nozzle corresponding to each piezoelectric element 53 (for example, large drops, middle drops, small drops). The driving waveform is generated according to the image to be formed.

Therefore, the piezoelectric element 53 provided in each recording head 15 is turned on according to the image signal, and at the same time, a voltage of a voltage level according to the driving waveform is continuously applied to the piezoelectric element 53 for a period of time according to the pulse width indicated by the driving waveform. This makes the piezoelectric element 53 to drive. That is, the ink droplets of the timing and amount according to the image signal and the driving waveform are discharged on the record medium 1 from the nozzle corresponding to the piezoelectric element 53 by driving the piezoelectric element 53.

In the example in FIG. 2, the recording apparatus 8 includes two drive control boards 18. Also, a case is shown where a total of 16 recording heads 15 are arranged on the recording apparatus 8, i.e., four rows in the transporting direction of the record medium 1 (refer to the direction of the arrow Y in FIG. 2), and four rows in the direction perpendicular to the transporting direction of the record medium 1 (the direction of the arrow X in FIG. 2). A case is also shown where eight recording heads 15 (two rows×four rows) have been connected to the single drive control board 18 by the cable 19.

However, the number of the recording heads 15 mounted on the recording apparatus 8 and the number of the recording heads 15 provided corresponding to the single drive control board 18 are not limited to this configuration.

Figure 3:
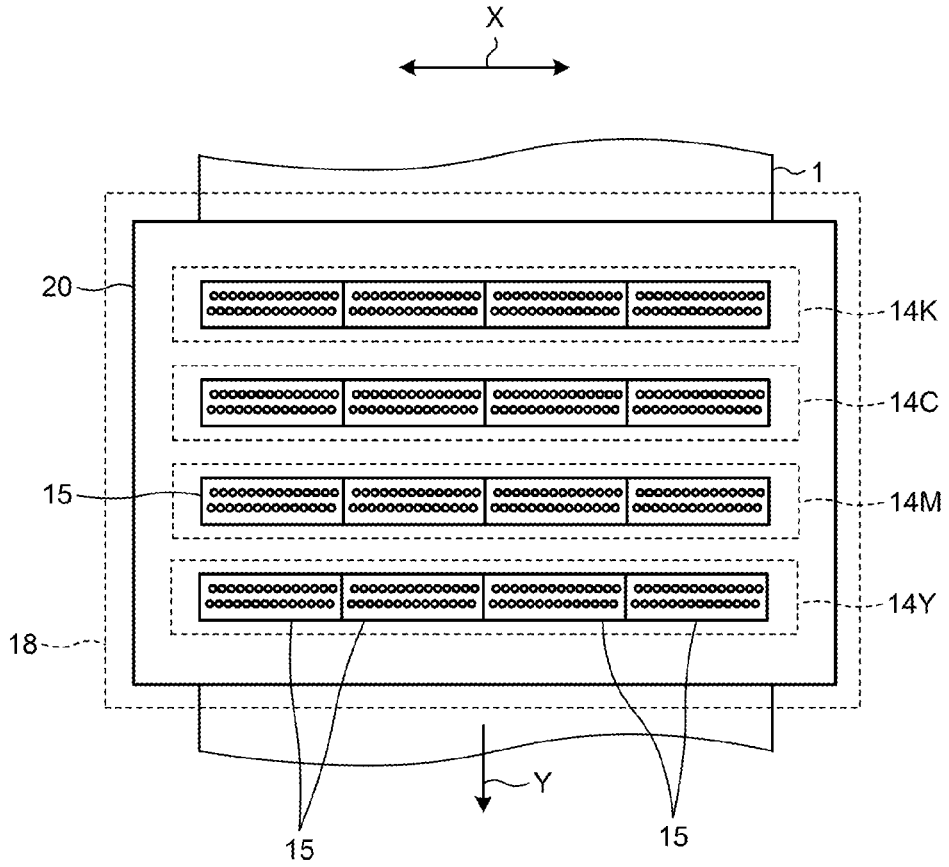
FIG. 3 is a schematic diagram of an exemplary arrangement of recording heads.

FIG. 3 is a schematic diagram of an exemplary arrangement of the recording heads 15. In the present embodiment, the plurality of recording heads 15 provided on the plate 20 discharges the ink droplets of different colors among the rows of the recording heads 15 arranged in the transporting direction of the record medium 1 (refer to a direction of an arrow Y in FIG. 3). Specifically, the plurality of recording heads 15 provided on the plate 20 includes an assembly of a black head array 14K for discharging black ink droplets, a cyan head array 14C for discharging cyan ink droplets, a magenta head array 14M for discharging a magenta ink droplets, and a yellow head array 14Y for discharging yellow ink droplets.

The respective head arrays (14K, 14C, 14M, 14Y) include four recording heads 15 arranged in a direction (a direction of an arrow X in FIG. 3) perpendicular to the transporting direction (the direction of the arrow Y in FIG. 3) of the record medium 1. A wide printed area width is secured by arranging the recording heads 15 in this way. The number of the recording heads 15 arranged in the transporting direction of the record medium 1 (the direction of the arrow Y in FIG. 3) and the number of the recording heads 15 arranged in the direction (the direction of the arrow X in FIG. 3) perpendicular to the transporting direction (the direction of the arrow Y in FIG. 3) is not limited to that of the example in FIG. 3.

Figure 4:
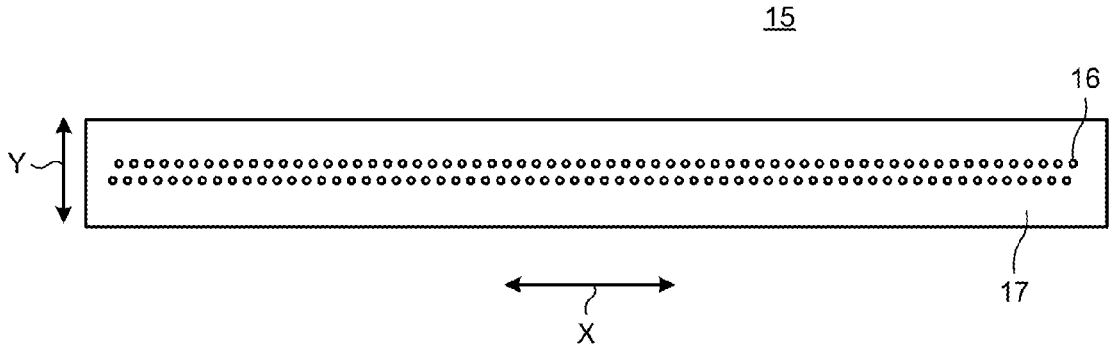
FIG. 4 is a schematic diagram of the recording head.

FIG. 4 is a schematic diagram of the recording head 15. Particularly, FIG. 4 is a plan view of the recording head 15 as viewed from a nozzle-side surface 17 for discharging the ink droplets (hereinafter referred to as a nozzle surface). A plurality of nozzles 16 is arranged on the nozzle surface 17 of the recording head 15. Each nozzle 16 is a discharge hole for discharging the ink droplets. In the present embodiment, an example is shown in which the nozzle surface 17 has the plurality of nozzles 16 arranged thereon. The plurality of nozzles 16 is arranged in a row in a direction (refer to a direction of an arrow X in FIG. 4) perpendicular to the transporting direction of the record medium 1 (refer to a direction of an arrow Y in FIG. 4), and two nozzle rows are arranged in the transporting direction (the direction of the arrow Y in FIG. 4). Also, the respective nozzles 16 in these nozzle rows are arranged in zigzag so that the nozzle 16 in the next row is located between the nozzles 16. A high-resolution image can be formed by arranging the nozzles 16 in zigzag.

Figure 5:
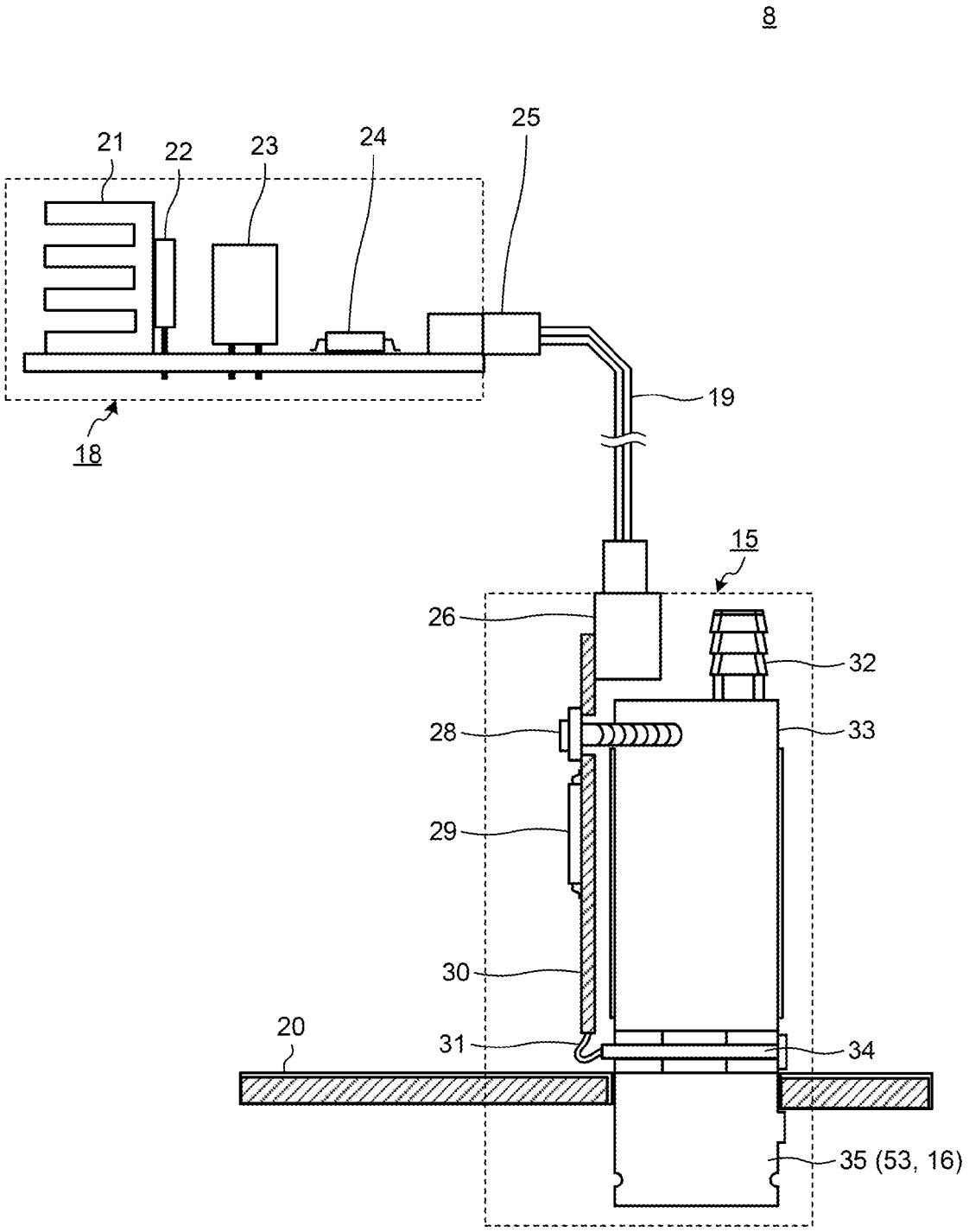
FIG. 5 is a side view of the recording apparatus.

FIG. 5 is a side view of the recording apparatus 8. In an example in FIG. 5, a configuration is shown in which the drive control board 18 is connected in one-to-one correspondence with the recording head 15 in order to simplify the description.

The drive control board 18 includes a current amplifier 22, a cooling fin 21, an electrolytic capacitor 23, a transmission-side field programmable gate array (FPGA) 24, and a connector 25. The current amplifier 22 amplifies a voltage of an analog signal of the driving waveform output from a D/A converter to be described below provided on the drive control board 18. The cooling fin 21 cools a Joule heat generated as loss of the current amplifier 22. The electrolytic capacitor 23 assists current supply to the piezoelectric element 53. The transmission-side FPGA 24 receives an image data of the image to be formed from a controller, which is not shown, provided in the ink jet recording apparatus 100 and generates the image signal and the driving waveform (to be described in detail below). The connector 25 removably holds the cable 19 and electrically connects each part of the drive control board 18 with the cable 19.

The recording head 15 includes a recording head controlling apparatus 30, a flexible printed board 31, a head tank 33, a head board 34, and a head unit 35. The recording head controlling apparatus 30 is a rigid board having a reception-side FPGA 29 and a connector 26 mounted thereon. The recording head controlling apparatus 30 is fixed on a side surface of the head tank 33 with a tapping screw 28.

The head tank 33 temporarily stores the ink and supplies the ink to the head unit 35. The ink is supplied to the head tank 33 via a known joint unit 32 provided on the upper part of the head tank 33. The reception-side FPGA 29 performs deserialization processing to the image signal which is serially transferred from the transmission-side FPGA 24 mounted on the drive control board 18 and transfers it in parallel to a driving unit 55. The transmission-side FPGA 24 and the reception-side FPGA 29 will be described in detail below.

The head unit 35 includes the piezoelectric elements 53 and the nozzles 16 described above. The head unit 35 discharges the ink droplets by the control of the recording head controlling apparatus 30.

The head board 34 is a rigid board to electrically connect the piezoelectric element 53 provided in the head unit 35 with the recording head controlling apparatus 30. The head board 34 is attached and arranged between the head unit 35 and the head tank 33.

The recording head controlling apparatus 30 is electrically connected to the head board 34 by the flexible printed board 31. The flexible printed board 31 is a substrate made of flexible material and can be easily bent.

As shown in FIG. 5, the current amplifier 22 and the cooling fin 21 are mounted outside the recording head 15 in the present embodiment. Also, the connector is not mounted, and the flexible printed board 31 and the head board 34 are used to connect the recording head controlling apparatus 30 with the head unit 35. Therefore, miniaturization of the recording apparatus 8 is realized.

Figure 6:
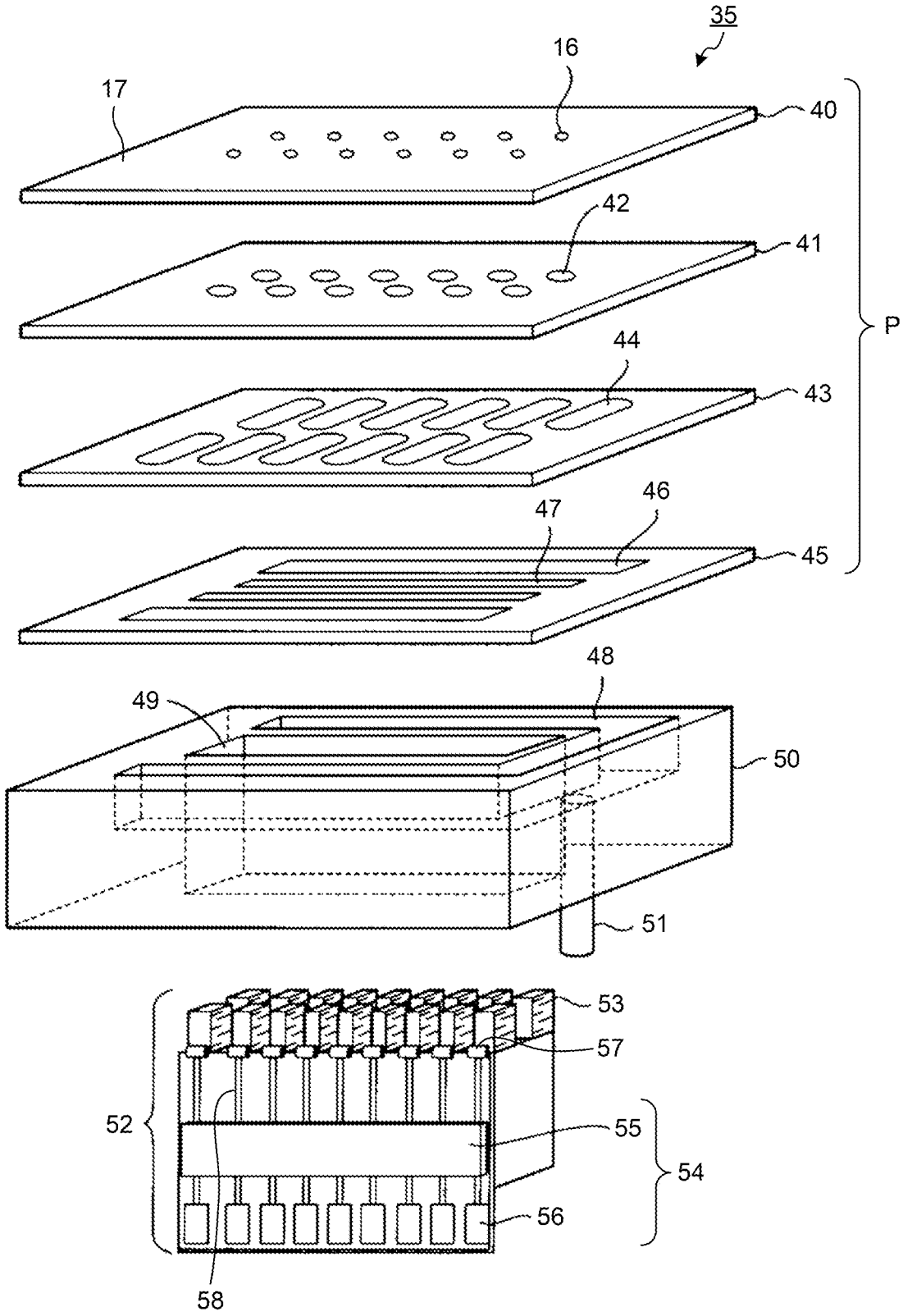
FIG. 6 is a schematic diagram of a dissolved head unit.

FIG. 6 is a schematic diagram of a dissolved head unit 35. The head unit 35 is a laminate of a nozzle plate 40, a pressure chamber plate 41, a restrictor plate 43, a diaphragm plate 45, a rigid plate 50, and a piezoelectric element group 52.

The plurality of nozzles 16 is arranged in zigzag on the nozzle plate 40. An upper surface of the nozzle plate 40 corresponds to the nozzle surface 17 in FIG. 6. The pressure chamber plate 41 is a substrate having pressure chambers 42 formed thereon in places corresponding to the nozzles 16. A restrictors 44 are provided on the restrictor plate 43 in places corresponding to the respective pressure chambers. A common ink passage 48 provided in the rigid plate 50 is communicated with the pressure chamber 42 provided on the pressure chamber plate 41 by the restrictor 44. At the same time, the restrictor 44 controls an flow rate of the ink flowing into the pressure chamber 42. A diaphragm 47 and a filter 46 are provided on the diaphragm plate 45. A passage plate P having an ink passage is formed by sequentially stacking on, positioning, and joining to the nozzle plate 40, the pressure chamber plate 41, the restrictor plate 43, and the diaphragm plate 45 one another.

The rigid plate 50 includes the common ink passage 48, an opening 49, and an ink introducing pipe 51. The passage plate P is joined to the rigid plate 50 so that the filter 46 opposes to an opening of the common ink passage 48.

An upper-side opening end of the ink introducing pipe 51 is connected to the common ink passage 48 of the rigid plate 50, and a lower-side opening end of the ink introducing pipe 51 is connected to the head tank not shown in FIG. 6 (refer to the head tank 33 in FIG. 5).

The piezoelectric element group 52 includes the plurality of piezoelectric elements 53. Particularly, the piezoelectric element group 52 includes the plurality of piezoelectric elements 53, a piezoelectric element supporting substrate 54, and piezoelectric element connecting electrode pads 57.

The piezoelectric element supporting substrate 54 includes an electrode pad 56, the driving unit 55, and a copper foil pattern 58. The electrode pad 56 electrically connects the head board 34 (refer to FIG. 5) with the driving unit 55. The electrode pad 56 is electrically connected to the head board 34 with soldering. The driving unit 55 applies a voltage indicated by the driving waveform transmitted from the drive control board 18 to the piezoelectric element 53 according to the image signal transferred in parallel from the reception-side FPGA 29 (refer to FIG. 5).

The piezoelectric element connecting electrode pad 57 electrically connects the piezoelectric element 53 with the copper foil pattern 58 and adheres the piezoelectric element 53 to the piezoelectric element supporting substrate 54. The copper foil pattern 58 electrically connects the piezoelectric element 53 with the driving unit 55.

The number of the nozzles 16, the pressure chambers 42, the restrictors 44, the piezoelectric elements 53 and the like is reduced to simplify the drawing in FIG. 6. Also, the description regarding a discharging operation of the ink droplets by the head unit 35 is not provided because it is generally known.

Figure 7:
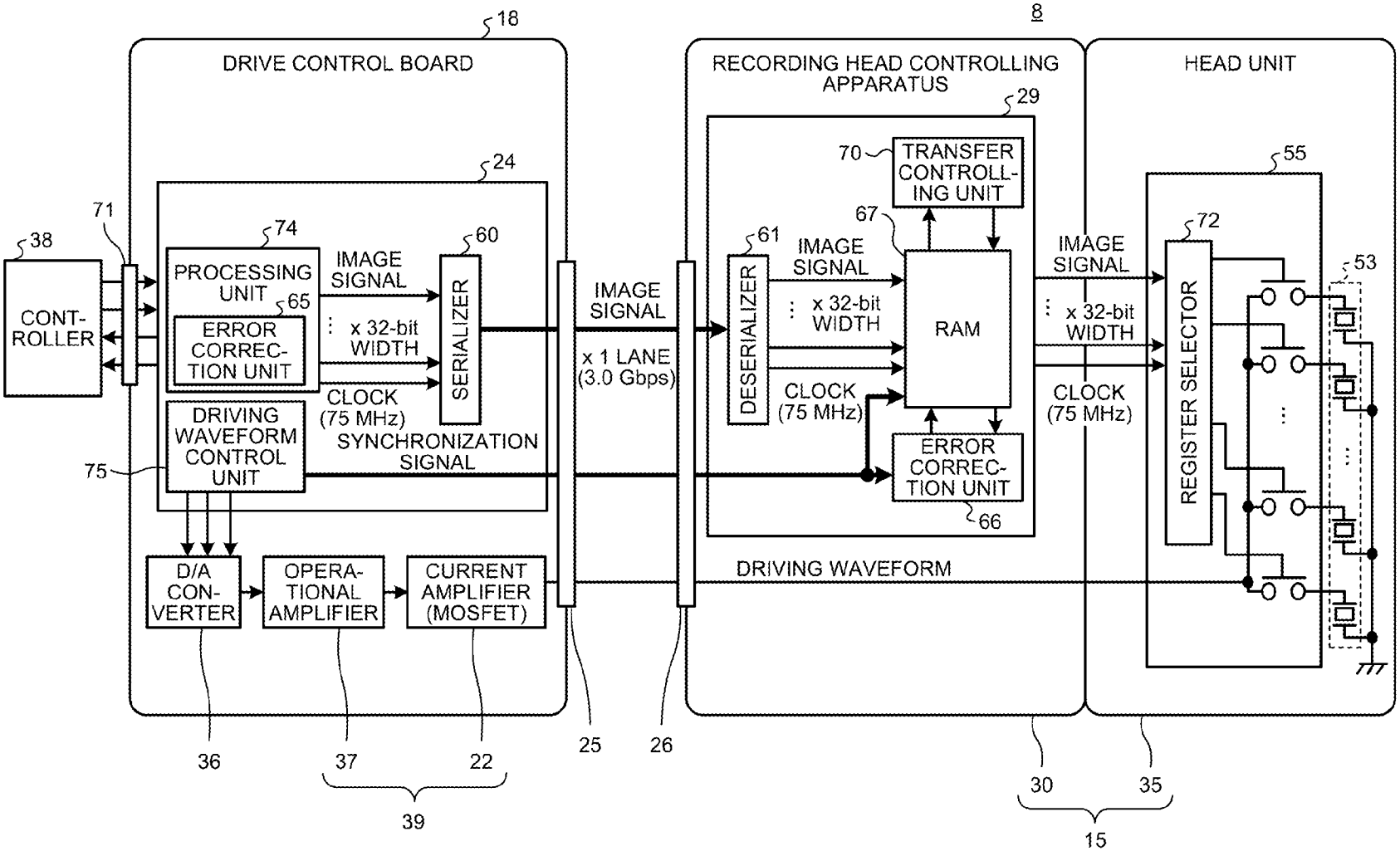
FIG. 7 a schematic diagram of an electrical configuration of the recording apparatus.

FIG. 7 is a schematic diagram of an electrical configuration of the recording apparatus 8. The recording apparatus 8 includes the drive control board 18 and the recording head 15. The recording head 15 includes the recording head controlling apparatus 30 and the head unit 35.

The drive control board 18 converts the arrangement of the image signals of the image to be formed via the connector 71 from a controller 38 and sequentially transmits the converted image signal to the recording head 15. Also, the drive control board 18 generates the driving waveform and transmits it to the recording head 15. The controller 38 controls the whole ink jet recording apparatus 100. The drive control board 18 includes the transmission-side FPGA 24, a D/A converter 36, and an amplifier 39. The transmission-side FPGA 24 includes a processing unit 74, a driving waveform control unit 75, and a serializer 60.

The processing unit 74 converts the image signal transferred from the controller 38 into a parallel data (for example, 32-bit width) and outputs it to the serializer 60 together with a clock signal. The clock signal is used to synchronize the image signal. It is assumed that a frequency of the clock signal be 75 MHz as an example in the present embodiment.

Here, the processing unit 74 includes an error correction unit 65 in the present embodiment. After performing an error correcting coding to the image signal generated by the processing unit 74 for each predetermined clock cycle, the error correction unit 65 performs an interleaving to the image signal and outputs it to the serializer 60. Specifically, the processing unit 74 performs the error correcting coding per clock cycle to the image signal in the order of the transfer from the controller 38. Further, the error correction unit 65 sorts and temporally deconcentrates (interleaving) two image signals for each clock cycle, i.e., one image signal to which the error correcting coding is performed in a clock cycle which has already been transferred from the controller 38 and one image signal to which the error correcting coding is performed in a latest clock cycle which has been transferred from the controller 38.

The processing unit 74 converts the image signal, to which the error correcting coding and the interleaving have been performed by the error correction unit 65, into the parallel data and sequentially outputs it to the serializer 60 together with the clock signal. Accordingly, the reliability of the data transfer can be improved.

The serializer 60 employs a clock-embedded architecture. The serializer 60 generates the serial signal in which the image signal and the clock signal are superimposed. The image signal is the input parallel data (32-bit width in the present embodiment). That is, the serializer 60 converts a parallel signal into the serial signal. The serial signal is generated by a transmitter (not shown) provided in the serializer 60.

The serializer 60 transmits the generated serial signal to the recording head 15 via the connector 25, the cable 19 (not shown in FIG. 7), and the connector 26. In the recording head 15, the reception-side FPGA 29, which will be described below, provided in the recording head controlling apparatus 30 receives the serial signal.

In the present embodiment, as an example, a case will be described where the serializer 60 employs a 8b/10b transfer method as a coding method, maps each bite of the parallel data to a 10-bit code, and performs serialization processing per code.

Data transfer speed from the drive control board 18 to the recording head 15 depends on a frequency of the clock signal output from the controller 38 to the serializer 60. In the present embodiment, it is assumed that the frequency be 75 MHz. Therefore, the description will be made while it is assumed that the data transfer speed be 3.0 Gbps (75 MHz×32 bit×10b/8b=3.0 Gbps).

The driving waveform control unit 75 generates the driving waveform. The driving waveform for each resolution is transferred from the controller 38 to the driving waveform control unit 75. The driving waveform control unit 75 converts the received driving waveform into the parallel data of 16-bit width and transmits it to the D/A converter 36. Also, the driving waveform control unit 75 transmits a synchronization signal for being used to synchronize the driving waveform to the recording head 15. In other words, the synchronization signal is a reference signal to generate the driving waveform by the driving waveform control unit 75.

The D/A converter 36 generates the driving waveform according to characteristics of the respective recording heads 15 by performing digital-to-analog conversion on the received driving waveform. The amplifier 39 receives the driving waveform from the D/A converter 36 and amplifies it. Specifically, the amplifier 39 includes an operational amplifier 37 and the current amplifier 22. The operational amplifier 37 amplifies a voltage of the driving waveform which is an analog signal output from the D/A converter 36. The current amplifier 22 amplifies a current of the driving waveform, of which the voltage is amplified, output from the operational amplifier 37 and transmits it to the recording head 15. The current amplifier 22 includes a MOSFET. The driving waveform is received by the driving unit 55 of the recording head 15 and used to control the piezoelectric element 53.

It is assumed that the resolution of the D/A converter 36 be 16 bits and an updating cycle of the data be 20 MHz in the present embodiment. Therefore, after analog voltage conversion is performed to the driving waveform as a 16-bit digital signal by the D/A converter 36, the voltage of the driving waveform is amplified by the operational amplifier 37. In the present embodiment, it is assumed that a gain of the operational amplifier 37 be 10 times.

The recording head 15 includes the recording head controlling apparatus 30 and the head unit 35. The recording head controlling apparatus 30 includes the connector 26 and the reception-side FPGA 29.

The connector 26 removably holds the cable 19 (not shown in FIG. 7) and electrically connects each part of the recording head 15 with the cable 19. The connector 26 receives the serial signal in which the clock signal and the image signal have been superimposed, the driving waveform, and the synchronization signal of the driving waveform from the drive control board 18 via the cable 19 (not shown in FIG. 7).

The reception-side FPGA 29 includes a deserializer 61, a RAM 67, a transfer controlling unit 70, and an error correction unit 66. The deserializer 61 corresponds to a restoration unit.

The deserializer 61 restores the image signal and the clock signal from the serial signal by deserializing the serial signal received from the drive control board 18. The serialization by the serializer 60 and the deserialization by the deserializer 61 are performed by using a known method.

The deserializer 61 sequentially stores the restored image signal and the clock signal in the RAM 67. The restored image signal is a 32-bit parallel data, for example.

In each clock cycle of the clock signal, a periodic rising edge (start bit and stop bit) certainly exists. Therefore, the deserializer 61 restores the serial signal to the 32-bit width parallel data (image signal) by detecting and synchronizing the edge.

The error correction unit 66 sequentially reads the image signal which has been restored by the deserializer 61 from the RAM 67. The image signal is an image signal to which the interleaving has been performed after the error correcting coding by the error correction unit 65 of the drive control board 18.

After performing the deinterleaving to the image signal read from the RAM 67, the error correction unit 66 performs an error correcting decoding. Then, the error correction unit 66 stores it to the RAM 67 again. The error correcting decoding performed by the error correction unit 66 is a method to decode the error correcting coding performed by the error correction unit 65 of the drive control board 18. Therefore, an error correcting decoding method is previously determined so that the error correction unit 66 performs the decoding corresponding to the error correcting coding performed by the error correction unit 65.

Figure 8:
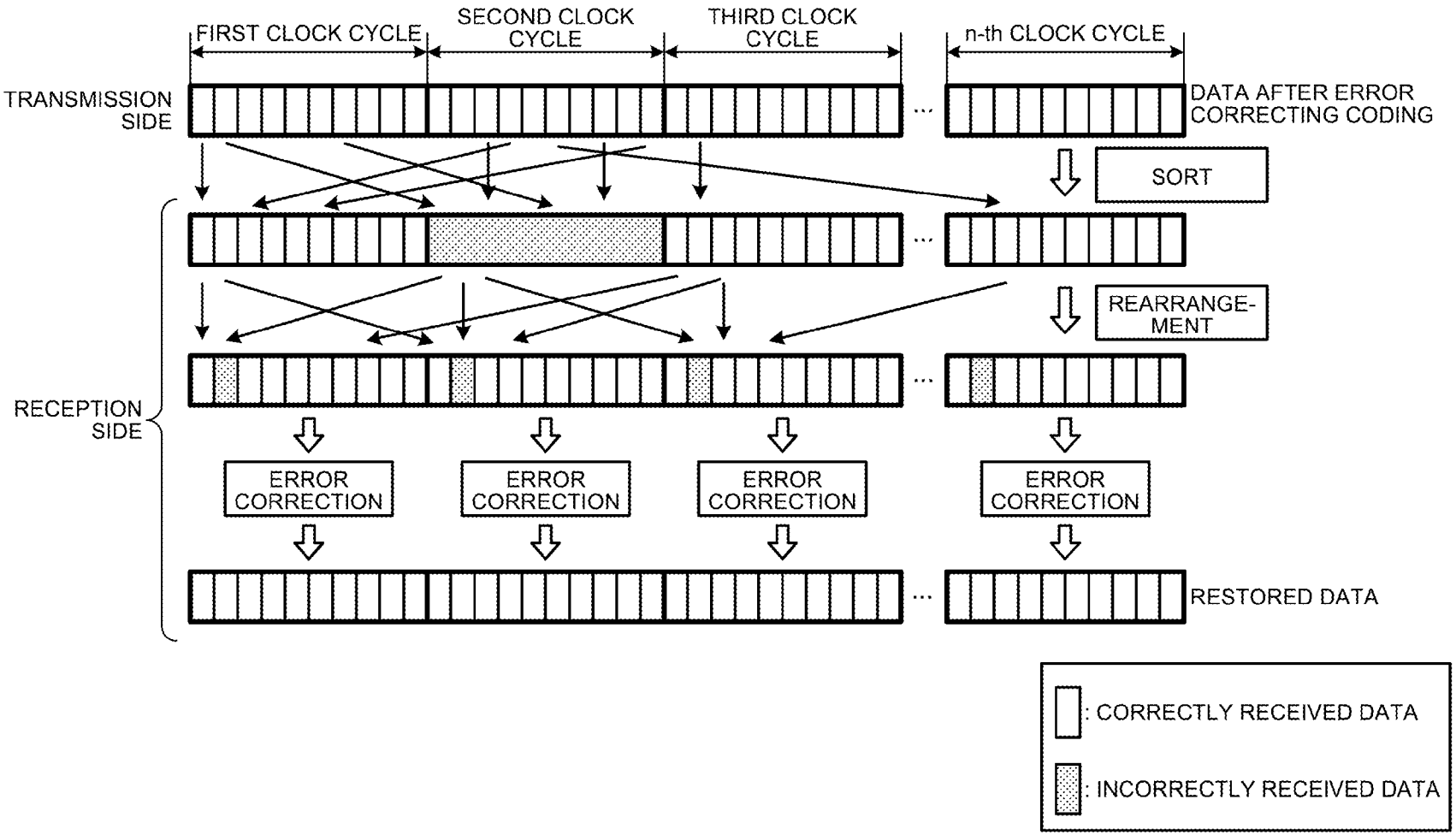
FIG. 8 is a diagram of exemplary processing by an error correction unit.

FIG. 8 is a diagram of exemplary processing by the error correction units 65 and 66. As shown in FIG. 8, the error correction unit 65 provided in the drive control board 18 which is a side of the transmission performs the interleaving to the image signal after performing the error correcting coding to the image signal per clock cycle (refer to the data after the error correcting coding in FIG. 8). The image signal, to which the interleaving (sort) is performed after the error correcting coding has been performed, is transmitted to the error correction unit 66 provided in the recording head 15 which is a side of the reception. The error correction unit 66 performs the error correcting decoding to the image signal (refer to the restored data in FIG. 8) after performing the deinterleaving (sort) to the image signal.

Returning to FIG. 7, the error correction unit 66 sequentially stores the image signal to which the deinterleaving and the error correcting decoding are performed to the RAM 67.

The transfer controlling unit 70 sequentially reads the image signal which is stored in the RAM 67 and to which processing is performed by the error correction unit 66. The transfer controlling unit 70 sequentially transmits the image signal to the driving unit 55 of the head unit 35 at the timing corresponding to the synchronization signal transmitted from the drive control board 18.

The synchronization signal is used to synchronize the driving waveform as described above and is a reference signal to generate the driving waveform by the driving waveform control unit 75. Therefore, even in a case where the clock-embedded architecture has been applied, variations in restoration time of the serializer 60 and the deserializer 61 can be absorbed by temporarily storing the image signal in the RAM 67 and synchronizing the driving waveform with the image signal input to the driving unit 55.

The head unit 35 includes the driving unit 55 and the piezoelectric element 53.

The driving unit 55 drives the piezoelectric element 53 according to the image signal and the driving waveform. Specifically, the driving unit 55 controls ON/OFF of the voltage supply to each piezoelectric element 53 according to the image signal sequentially transmitted from the transfer controlling unit 70. Also, the driving unit 55 controls a voltage waveform applied to each piezoelectric element 53 (pulse width and voltage level) according to the driving waveform transmitted from the drive control board 18.

More particularly, the driving unit 55 includes a register selector 72. The image signal restored to the 32-bit width parallel data by the deserializer 61 is input to the register selector 72. The register selector 72 changes ON/OFF of an analog switch to switch ON/OFF of the voltage supply to each piezoelectric element 53 according to the received image signal. Accordingly, the driving unit 55 controls ON/OFF of the voltage supply to the piezoelectric element 53. Also, the driving unit 55 applies the voltage of the pulse width and the voltage level indicated by the driving waveform to each piezoelectric element 53. The ink droplet of a concentration (ink droplet amount) corresponding to each pixel is discharged from the nozzle 16, which is provided corresponding to the piezoelectric element 53, in a position corresponding to each pixel of the image to be formed by driving the piezoelectric element 53 through the control of the driving unit 55.

Figure 9:
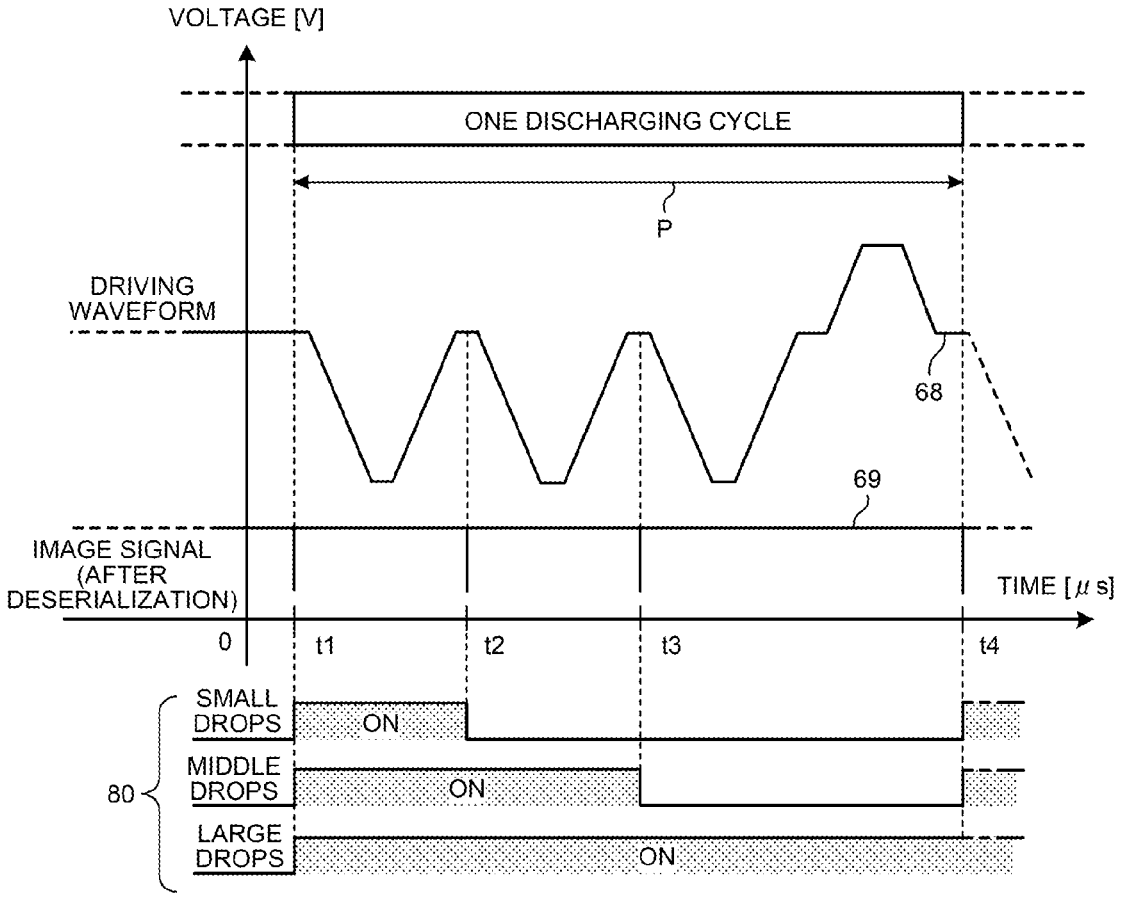
FIG. 9 is a diagram of relationship among an image signal, a driving waveform, and on time in the recording apparatus of the present embodiment.

FIG. 9 is a diagram of relationship among an image signal 69 transmitted to the recording head 15, a driving waveform 68, and a time to supply the voltage to the piezoelectric element 53 (on time) 80 of the recording apparatus 8 in the present embodiment. The image signal 69 in FIG. 9 is a deserialized image signal which has been sequentially read from the RAM 67 by the control of the transfer controlling unit 70 and transmitted to the recording head 15. The on time 80 is an on time of the voltage applied to the piezoelectric element 53 by the control of the driving unit 55 based on the image signal and the driving waveform. In the example in FIG. 9, the driving waveform indicates on time to discharge large drops of the ink droplets from the nozzle 16, on time to discharge middle drops of the ink droplets, and on time to discharge small drops of the ink droplets.

Also, the driving waveform and the image signal in a cycle in which the driving unit 55 once discharges the ink droplets from the nozzle 16 of the recording head 15 provided in the recording apparatus 8 (refer to one discharging cycle P in FIG. 9) are shown in FIG. 9.

In the recording apparatus 8 of the present embodiment, the image signal restored by the deserializer 61 is not directly transmitted to the recording head 15, is sequentially read by the control of the transfer controlling unit 70 after once stored in the RAM 67, and sequentially transmitted to the recording head 15 at the timing corresponding to the synchronization signal of the driving waveform.

For this reason, in the piezoelectric element 53 in the recording apparatus 8 of the present embodiment, a timing in which voltage variation of the driving waveform 68 is constant (refer to time t1, t2, t3, and t4 in FIG. 9) can be coincide with a timing to turn on the piezoelectric element 53 indicated by the image signal 69. Therefore, the recording apparatus 8 of the present embodiment can realize stable discharge characteristics, and the image quality can be improved.

Also, since the serial signal in which the clock signal and the image signal have been superimposed is transmitted from the drive control board 18 to the recording head controlling apparatus 30, the image quality can be improved while the wiring can be simplified.

On the other hand, conventionally, the image signal restored by the deserializer 61 has been directly transmitted to the recording head 15 without being performed storage processing such as temporary storage.

Figure 10:
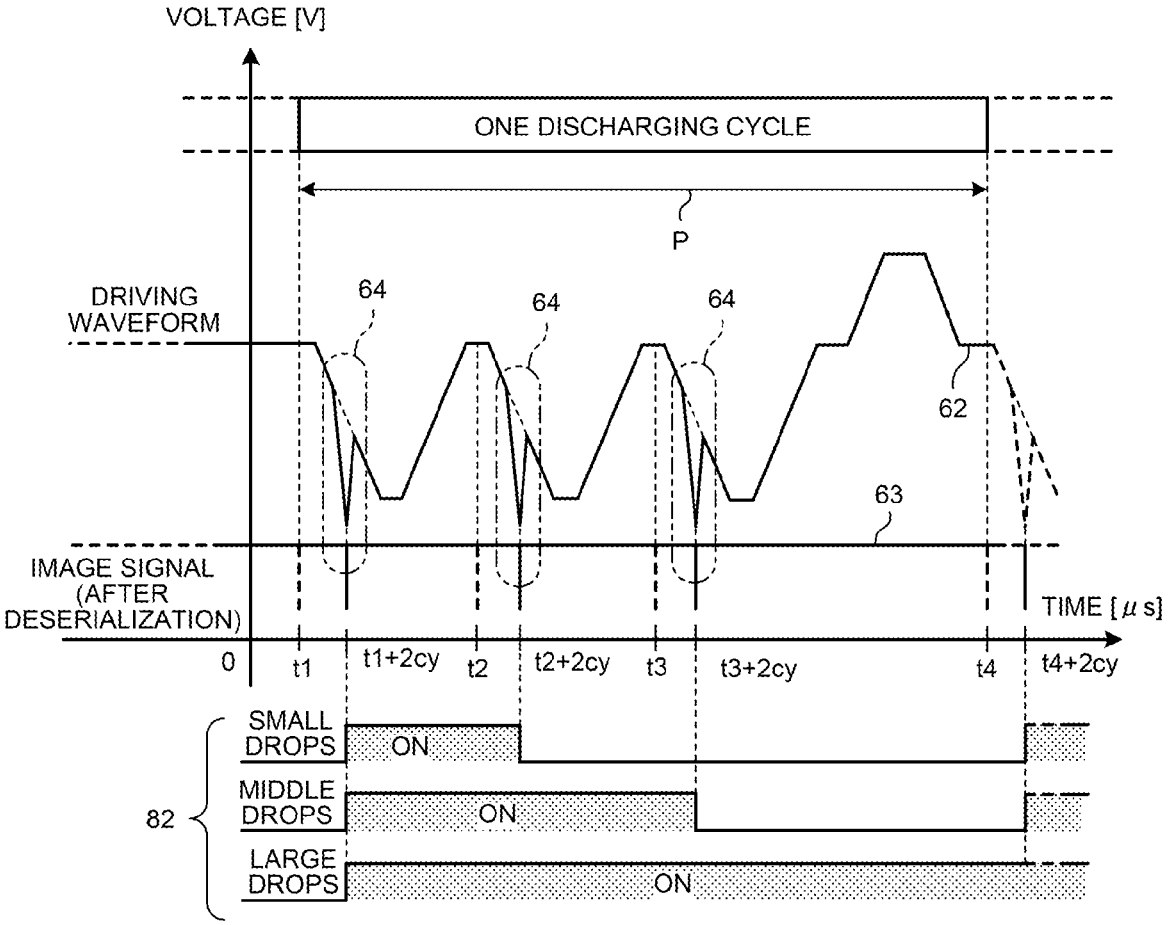
FIG. 10 is a diagram of relationship among an image signal, a driving waveform, and on time in a conventional recording apparatus.

FIG. 10 is a diagram of relationship among the driving waveform, the image signal, and on time 82 in a conventional recording apparatus.

As shown in FIG. 10, conventionally, since the image signal restored by the deserializer 61 is directly transmitted to the recording head 15, the image signal varies from the driving waveform, which is separately transmitted, for several clock cycles during the serialization processing and deserialization processing of the image signal (refer to expressions "t1+2cy", "t2+2cy", "t3+2cy", and "t4+2cy" in FIG. 10, respective expressions indicate that gaps of two clock cycles are generated from t1, t2, t3, and t4). Therefore, conventionally, there has been a case where a gap is generated between a timing to apply the voltage based on the driving waveform to the piezoelectric element 53 and an output of the image signal to control ON/OFF of the piezoelectric element 53 and the piezoelectric element 53 drives at the timing different from the timing corresponding to the image to be formed. Also, for this reason, there has been a case where distortion is generated in the driving waveform applied to the piezoelectric element 53 and discharging speed of the ink droplets discharged from the nozzle 16 becomes unstable. Therefore, image quality deterioration has conventionally occurred.

On the other hand, the transfer controlling unit 70 in the recording apparatus 8 of the present embodiment does not directly transmit the image signal restored by the deserializer 61 to the recording head 15. The transfer controlling unit 70 sequentially transmits the image signal to the driving unit 55 of the recording head 15 at the timing corresponding to the synchronization signal of the driving waveform after once storing the image signal in the RAM 67.

The synchronization signal is used to synchronize the driving waveform as described above and is a reference signal to generate the driving waveform by the driving waveform control unit 75. Therefore, even in a case where the clock-embedded architecture has been applied, variations in restoration time of the serializer 60 and the deserializer 61 can be absorbed by temporarily storing the image signal in the RAM 67 and synchronizing the driving waveform 64 with the image signal input to the driving unit 55.

Therefore, the recording apparatus 8 of the present embodiment can realize stable discharge characteristics, and the image quality can be improved.

Also, the recording apparatus 8 of the present embodiment includes the error correction units 65 and 66. Therefore, even when a burst error (a large number of errors concentrated in sequential short periods) has occurred by the influence of the noise such as static electricity in the image signal transmitted from the drive control board 18 to the recording head 15, the image signal can be easily restored on the side of the error correction unit 66. That is, erroneous data is deconcentrated in each clock cycle, and the error correction for per bit in each clock cycle can be performed. Therefore, the image signal can be normally restored on the side of the recording head 15.

Also, when the deinterleaving is performed, it is necessary that the image signals for a plurality of clock cycles be temporarily stored. However, since the image signal is sequentially stored in the RAM 67, the deinterleaving can be performed without any difficulty in the present embodiment. Accordingly, a transfer error and the like can be suppressed, and a more reliable ink jet recording apparatus 100 can be provided.

Therefore, it becomes possible to provide the recording apparatus 8 of the present embodiment having higher reliability in addition to the above effect.

The transmission-side FPGA 24, the D/A converter 36, the operational amplifier 37, the current amplifier 22, the processing unit 74, the error correction unit 65, the driving waveform control unit 75, the serializer 60, the deserializer 61, the transfer controlling unit 70, the error correction unit 66, and the driving unit 55 may be realized by executing a program by a processing apparatus, for example, such as a central processing unit (CPU), i.e., by a software. Also, these units may be realized by a hardware such as an integrated circuit (IC) and may be realized by using both the software and the hardware.

According to present embodiment, it is possible to improve the image quality.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A recording head controlling apparatus comprising:

a memory;

a restoration unit configured to restore a clock signal and an image signal from a serial signal, in which the serial signal has a superimposed clock signal and image signal, and to store the restored clock signal and the restored image signal in the memory; and a transmission control unit configured to receive a synchronization signal of a driving waveform to drive each piezoelectric element, and to read and transmit the image signal stored in the memory to a driving unit for driving the piezoelectric element at a timing corresponding to the synchronization signal.

2. The recording head controlling apparatus according to claim 1, further comprising:

an error correction unit configured to read the image signal to which an interleaving is performed from the memory after performing error correcting coding to each set clock cycle and to store the image signal in the memory after performing de-interleaving and error correcting decoding, wherein the transmission control unit transmits the image signal to which the de-interleaving and the error correcting decoding are performed to the driving unit at the timing corresponding to the synchronization signal.

3. A recording head according to claim 1, the recording head comprising:

the recording head controlling apparatus of claim 1;

a plurality of piezoelectric elements; and a driving unit configured to receive the image signal from the recording head controlling apparatus and receive the driving waveform from a drive control board for outputting the driving waveform to drive the piezoelectric elements and drive the piezoelectric elements according to the image signal and the driving waveform.

4. A recording apparatus according to claim 1, the recording apparatus comprising:

a drive control board configured to output a serial signal in which a clock signal and an image signal are superimposed and a driving waveform to drive each piezoelectric element;

the recording head controlling apparatus of claim 1;

a plurality of piezoelectric elements; and a driving unit configured to receive the driving waveform from the drive control board and receive the image signal from the recording head controlling apparatus and drive the piezoelectric elements according to the image signal and the driving waveform.

5. An image forming apparatus according claim 4, the image forming apparatus comprising the recording apparatus of claim 4.

* * * * *